US009388746B2

(12) United States Patent
Russ

(10) Patent No.: US 9,388,746 B2
(45) Date of Patent: Jul. 12, 2016

(54) VACUUM GENERATION WITH A PERIPHERAL VENTURI

(71) Applicant: Ford Global Technologies, LLC, Dearborn, MI (US)

(72) Inventor: Stephen George Russ, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 796 days.

(21) Appl. No.: 13/681,072

(22) Filed: Nov. 19, 2012

(65) Prior Publication Data

US 2014/0137839 A1 May 22, 2014

(51) Int. Cl.
*F02D 9/08* (2006.01)
*F02D 9/10* (2006.01)

(52) U.S. Cl.
CPC ..... *F02D 9/08* (2013.01); *F02D 9/1055* (2013.01)

(58) Field of Classification Search
CPC ..... F02D 9/08; F02D 9/104; F02D 9/1045; F02D 9/1055; F02D 2009/024; F02M 35/10222; F02M 35/10229; F02M 35/10262; F02M 25/0722; B60T 13/52; B60T 13/563; B60T 17/02
USPC ..... 123/337, 73 PP, 184.45, 184.56, 336, 123/339.23, 403, 432, 439, 442, 585–587
See application file for complete search history.

(56) References Cited

U.S. PATENT DOCUMENTS 2,659,354 A * 11/1953 Nicolls ..... 123/382
2,756,729 A * 7/1956 Wolcott ..... 123/25 L
4,137,879 A * 2/1979 Kageyama et al. ..... 123/568.17
4,150,646 A * 4/1979 Aoyama et al. ..... 123/676
4,271,795 A * 6/1981 Nakagawa et al. ..... 123/308
4,308,837 A * 1/1982 Nohira et al. ..... 123/442
4,323,038 A * 4/1982 Motosugi et al. ..... 123/188.14
4,414,162 A * 11/1983 Ii et al. ..... 261/23.2
4,462,367 A * 7/1984 Tanabe et al. ..... 123/442
4,491,106 A 1/1985 Morris
4,543,931 A * 10/1985 Hitomi et al. ..... 123/308
4,558,678 A * 12/1985 Nishimura et al. ..... 123/494

(Continued)

FOREIGN PATENT DOCUMENTS

JP 54108128 A * 8/1979 ..... F02D 1/06
JP 04237860 A * 8/1992 ..... F02M 25/08

(Continued)

OTHER PUBLICATIONS

Ulrey, Joseph Norman et al., "Method and System for Fuel Vapor Management," U.S. Appl. No. 13/660,884, filed Oct. 25, 2012, 30 pages.

(Continued)

*Primary Examiner* — Mahmoud Gimie
*Assistant Examiner* — John Zaleskas
(74) *Attorney, Agent, or Firm* — James Dottavio; Alleman Hall McCoy Russell & Tuttle LLP

(57) ABSTRACT

Embodiments for generating vacuum at a throttle are presented. In one example, a system comprises a throttle positioned in an intake of an engine, and a peripheral venturi proximate the throttle, the venturi having an inlet positioned to interface with an edge of the throttle when the throttle is in a partially open position. In this way, vacuum may be generated by flow air through the venturi.

16 Claims, 5 Drawing Sheets

(56) References Cited

U.S. PATENT DOCUMENTS

| | | | | |
|---|---|---|---|---|
| 4,612,895 | A * | 9/1986 | Kuroiwa et al. | 123/494 |
| 4,709,677 | A * | 12/1987 | Muraji | 123/438 |
| 4,779,580 | A * | 10/1988 | Rutschmann | 123/184.54 |
| 4,886,034 | A * | 12/1989 | Lambert | 123/587 |
| 4,895,125 | A * | 1/1990 | Geiger | 123/568.11 |
| 4,899,708 | A | 2/1990 | Jung | |
| 5,103,794 | A * | 4/1992 | Shiraishi | 123/520 |
| 5,179,917 | A * | 1/1993 | Hokazono et al. | 123/184.45 |
| 5,611,204 | A * | 3/1997 | Radovanovic et al. | 60/605.2 |
| 6,058,917 | A * | 5/2000 | Knowles | 123/573 |
| 6,308,682 | B1 * | 10/2001 | Ma | 123/295 |
| 6,425,356 | B1 * | 7/2002 | Pischinger et al. | 123/90.15 |
| 6,843,224 | B2 * | 1/2005 | Ha | 123/337 |
| 6,851,664 | B2 | 2/2005 | Gangler et al. | |
| 6,951,199 | B2 * | 10/2005 | Suzuki | 123/339.11 |
| 7,013,851 | B2 * | 3/2006 | Prager | 123/73 PP |
| 7,174,883 | B2 * | 2/2007 | Sonoda et al. | 123/586 |
| 7,258,327 | B2 * | 8/2007 | Prager | 261/46 |
| 7,353,812 | B1 * | 4/2008 | Gosdzinski et al. | 123/585 |
| 7,637,244 | B2 * | 12/2009 | Akazaki et al. | 123/337 |
| 7,694,943 | B2 * | 4/2010 | Mason et al. | 261/23.3 |
| 2001/0007250 | A1 * | 7/2001 | Hattori et al. | 123/339.1 |
| 2003/0217739 | A1 * | 11/2003 | Saeki et al. | 123/543 |
| 2004/0011341 | A1 * | 1/2004 | Asano et al. | 123/585 |
| 2004/0182363 | A1 * | 9/2004 | Suzuki | 123/339.11 |
| 2007/0227495 | A1 * | 10/2007 | Isaji et al. | 123/306 |
| 2007/0236083 | A1 * | 10/2007 | Kawamori et al. | 303/114.3 |
| 2007/0246009 | A1 * | 10/2007 | Suzuki et al. | 123/336 |
| 2008/0121480 | A1 * | 5/2008 | Kawamori et al. | 188/356 |
| 2008/0136252 | A1 * | 6/2008 | Ro | 303/113.4 |
| 2010/0300413 | A1 * | 12/2010 | Ulrey et al. | 123/518 |
| 2011/0100325 | A1 * | 5/2011 | Wu | 123/337 |
| 2011/0120432 | A1 * | 5/2011 | Ulrey et al. | 123/568.15 |
| 2011/0183812 | A1 * | 7/2011 | Cunningham et al. | 477/183 |
| 2013/0091844 | A1 * | 4/2013 | Leone et al. | 60/707 |
| 2013/0092125 | A1 * | 4/2013 | Leone et al. | 123/319 |
| 2013/0092126 | A1 * | 4/2013 | Leone et al. | 123/399 |
| 2014/0116399 | A1 * | 5/2014 | Ulrey et al. | 123/520 |

FOREIGN PATENT DOCUMENTS

| | | | | |
|---|---|---|---|---|
| JP | 08312358 | A * | 11/1996 | F02B 31/00 |
| JP | 11342840 | A * | 12/1999 | B60T 17/00 |
| JP | 2005201196 | A * | 7/2005 | F02M 69/32 |

OTHER PUBLICATIONS

Anonymous, "Green Fuel Tank Refueling Method," IPCOM No. 000239371, Published Nov. 3, 2014, 2 pages.

* cited by examiner

VACUUM GENERATION WITH A PERIPHERAL VENTURI

FIELD

The present disclosure relates to an internal combustion engine.

BACKGROUND AND SUMMARY

Multiple vehicle subsystems, such as the vehicle brakes, may utilize vacuum as an actuation force. The vacuum is typically supplied by the engine through a connection to the intake manifold, which is at sub-barometric pressure when the throttle is partially closed and regulating the airflow into the engine. However, the engine intake manifold vacuum may not be sufficient for all of the subsystems at all operating conditions. For example, during a catalyst heating mode immediately after engine starting, a high level of spark retard may be used to generate exhaust heat directed to the catalyst, resulting in insufficient vacuum from the intake manifold.

The inventors have recognized the issues with the above approach and offer a system to at least partly address them. In one embodiment, a system comprises a throttle positioned in an intake of an engine, and a peripheral venturi proximate the throttle, the venturi having an inlet positioned to interface with an edge of the throttle when the throttle is in a partially open position.

In this way, vacuum may be generated by the peripheral venturi when the throttle is partially opened, e.g., at an angle that may not produce a sufficient pressure drop across the throttle to generate adequate vacuum in the intake manifold. The size of the venturi inlet and positioning relative to the throttle may be based on the throttle angle typically used during conditions where intake manifold vacuum is not sufficient, such as during the catalyst heating mode described above. By routing a portion of the intake air through the venturi, vacuum may be generated during conditions of low intake manifold vacuum.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
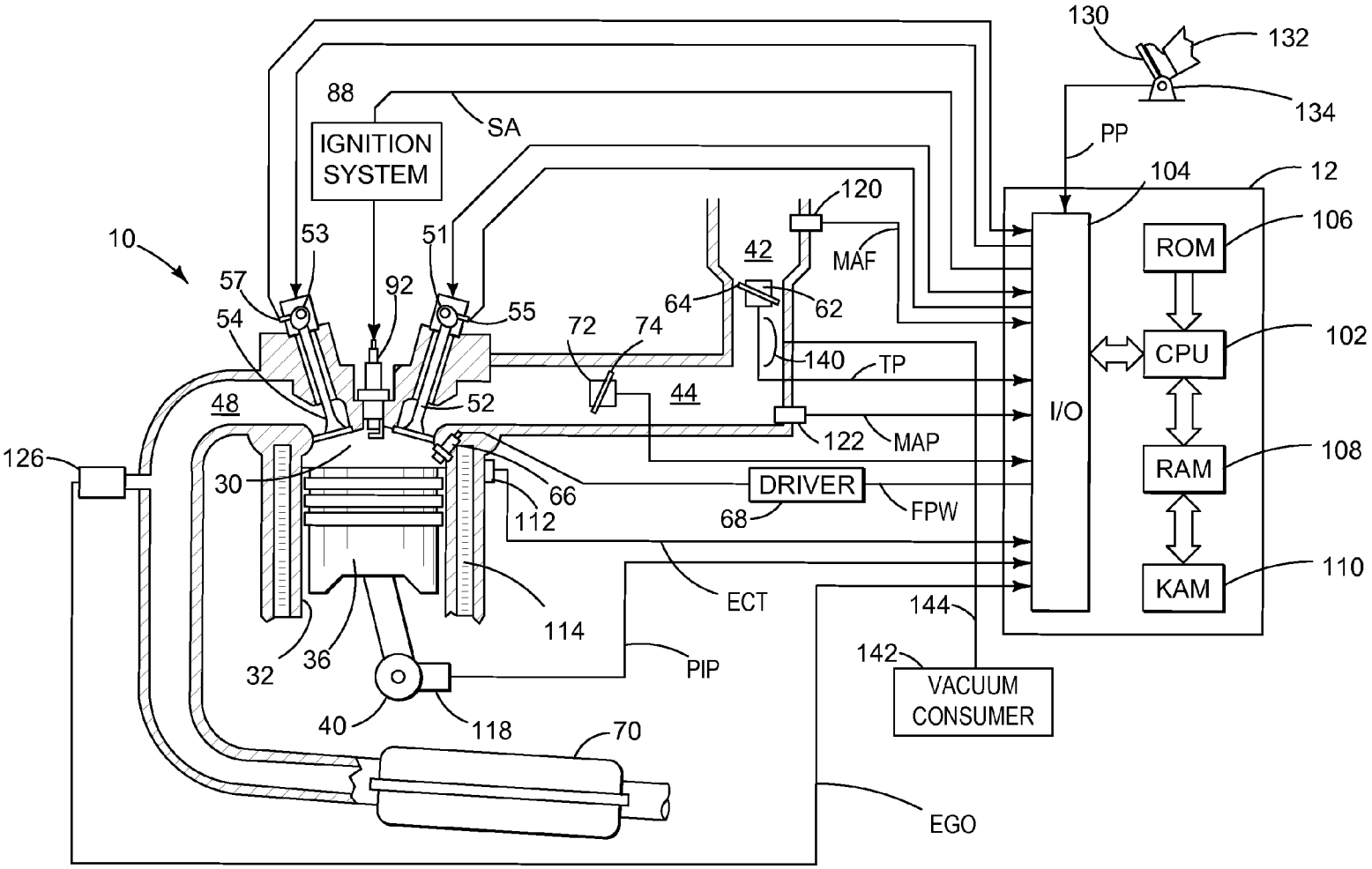
FIG. 1 shows a schematic diagram of an engine.
Figure 2A:
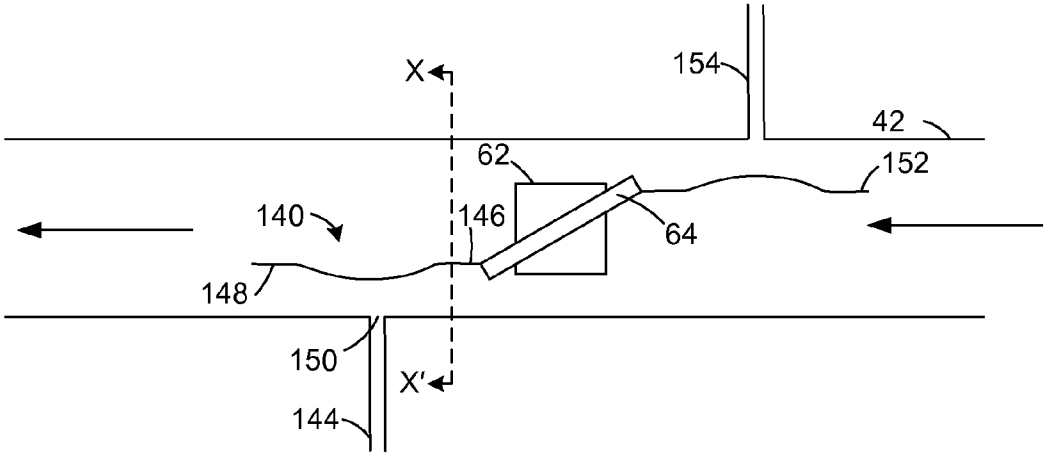
FIG. 2A shows a schematic diagram of an intake passage.
Figure 2B:
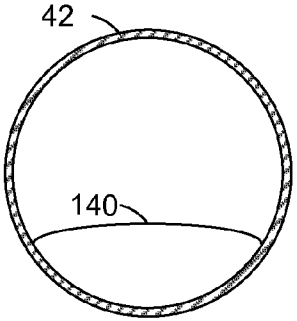
FIG. 2B shows a cross-section of the intake passage of FIG. 2A.
Figure 3:
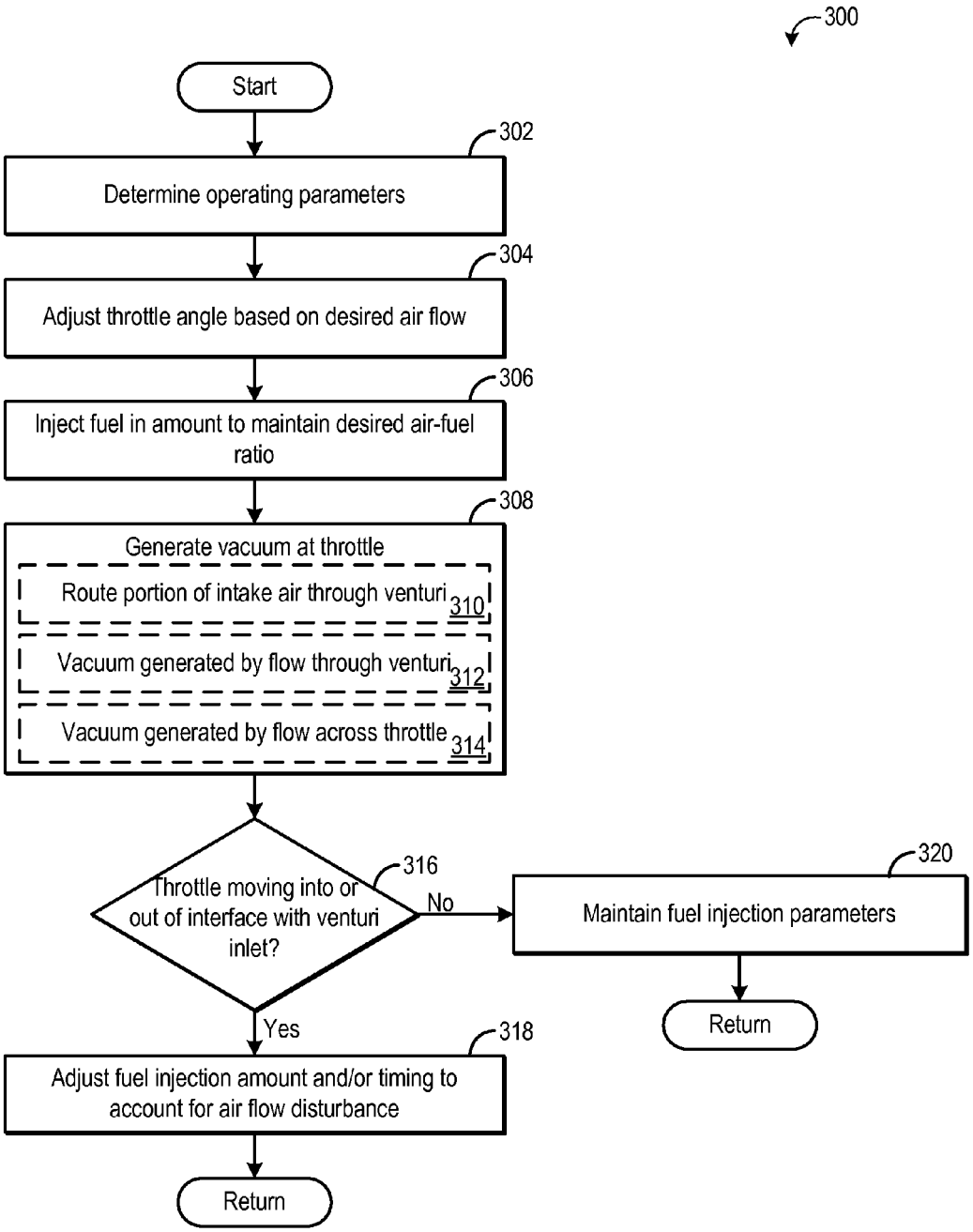
FIG. 3 is a flow chart illustrating an example method for generating vacuum in an intake of an engine.
Figure 4:
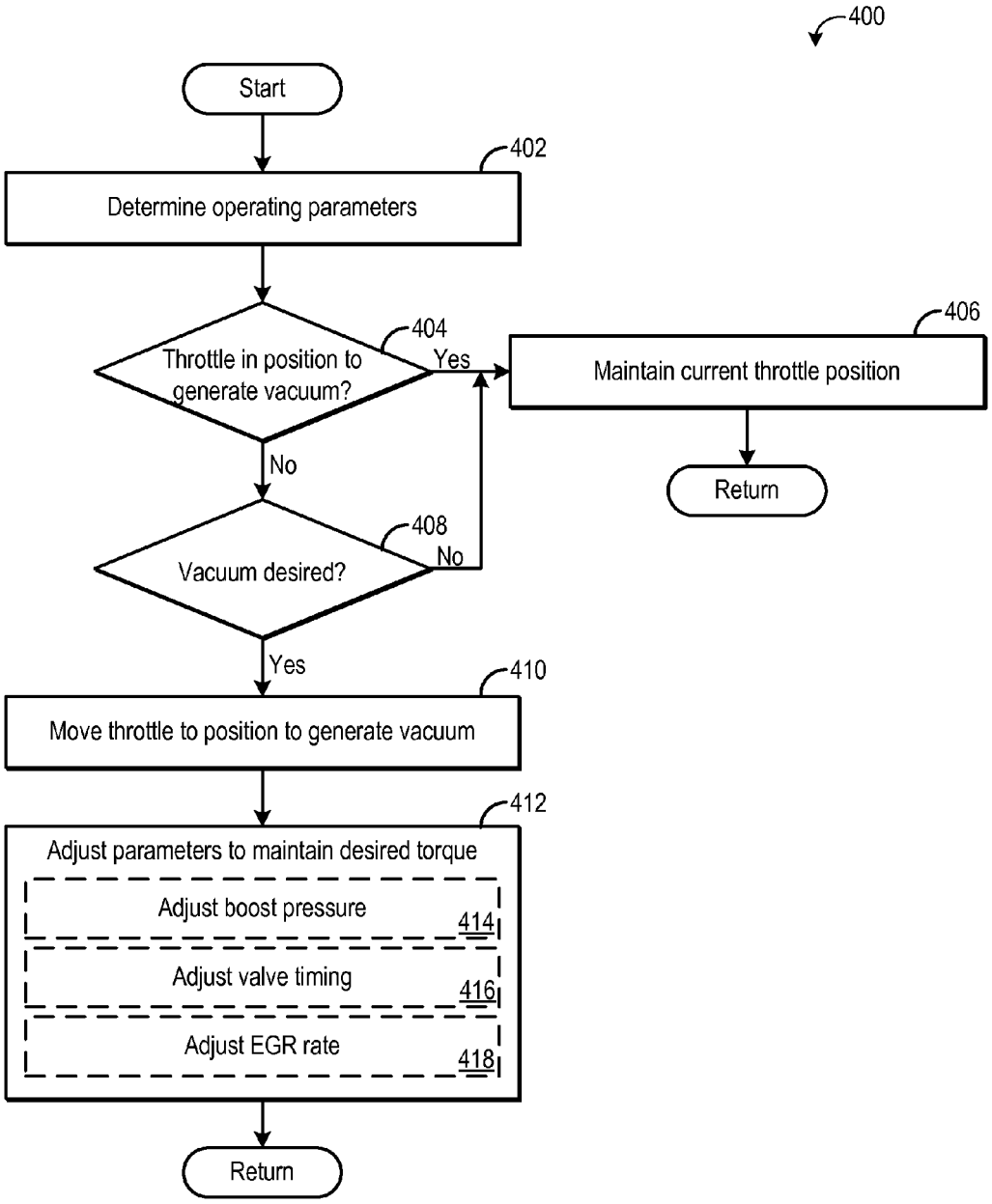
FIG. 4 is a flow chart illustrating an example method for adjusting operating during vacuum generation.
Figure 5:
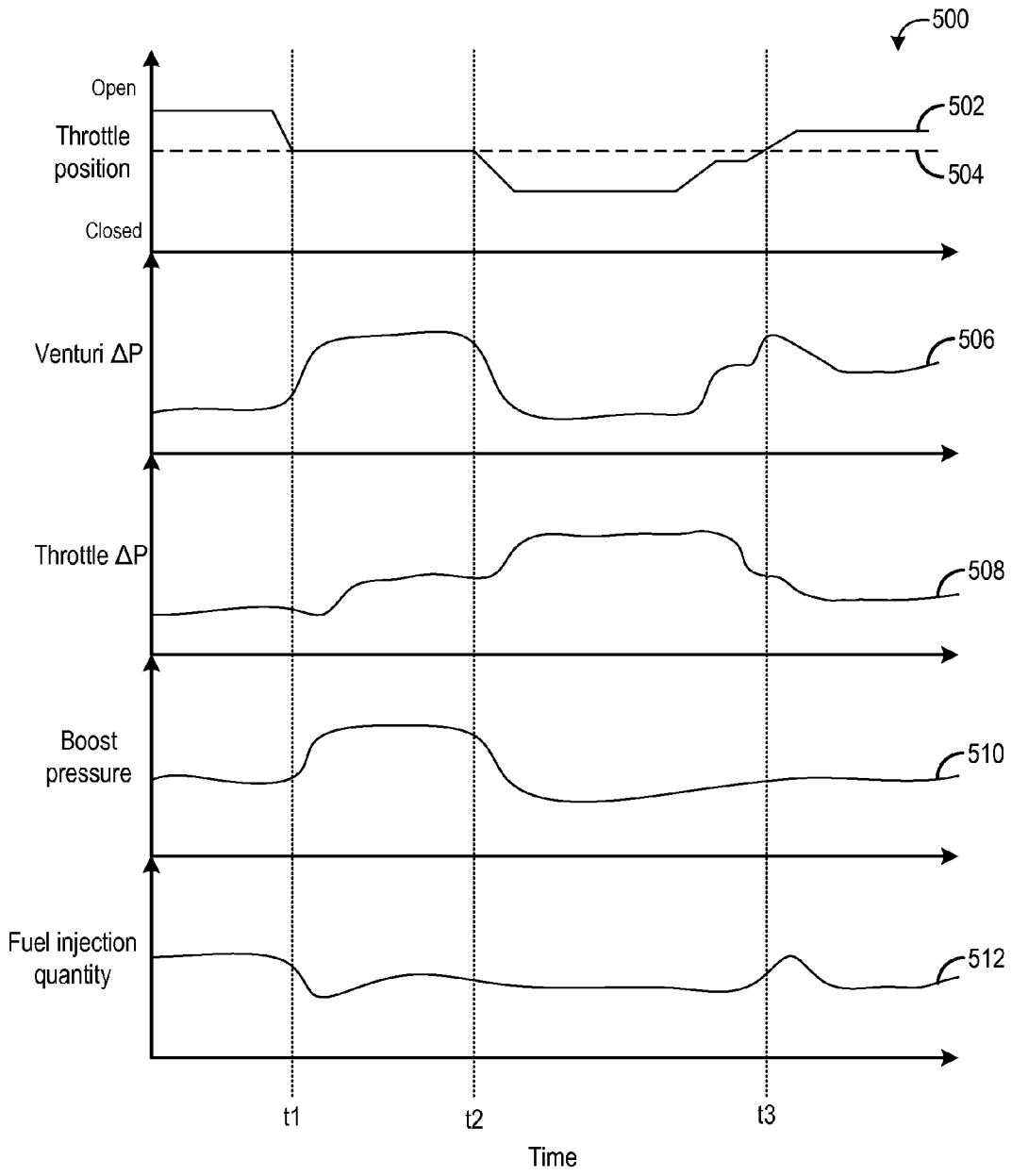
FIG. 5 is a diagram illustrating example operating parameters during the execution of the methods of FIGS. 3 and 4.

According to embodiments disclosed herein, a throttle body may include a high velocity passage incorporated into the inward opening side of the throttle body. The intake air may then flow through this passage at high velocity, resulting in a lower static pressure in this area relative to the rest of the intake manifold. A vacuum port is incorporated into the throttle body at the throat or exit of the high-velocity passage so that this vacuum can be routed to appropriate engine systems. The geometry of the high-velocity passage may be designed in such a manner that the air stream and vacuum generation is maximized at the throttle angles used during operating conditions that would otherwise not produce sufficient vacuum (e.g. during catalyst heating at altitude). An engine including a throttle body having a high velocity passage is illustrated in FIG. 1. FIGS. 2A and 2B illustrated the throttle body of FIG. 1 in greater detail. Methods for generating vacuum through the high-velocity passage are illustrated in FIGS. 3 and 4 and example operating parameters during the execution of the methods are illustrated in FIG. 5.

Referring specifically to FIG. 1, it includes a schematic diagram showing one cylinder of multi-cylinder internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 10 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion cylinder 30 may receive intake air from intake manifold 44 via intake passage 42 and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some embodiments, combustion cylinder 30 may alternatively or additionally include a fuel injector arranged in intake passage 42 in a configuration that provides what is known as port injection of fuel into the intake port upstream of combustion cylinder 30.

Intake passage 42 may include a charge motion control valve (CMCV) 74 and a CMCV plate 72 and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 120 and a manifold air pressure sensor 122 for providing respective signals MAF and MAP to controller 12.

A high-velocity passage 140, also referred to as a peripheral venturi 140, may be positioned on a downstream side of throttle 62. The high-velocity passage may be in the form of a venturi, ejector, injector, eductor, jet pump, or similar passive device. While not shown in FIG. 1, a venturi may alternatively or additionally be positioned downstream of CMCV 74.

Venturi 140 may have an upstream motive flow inlet via which air enters the ejector, a throat or entraining inlet fluidically communicating with a vacuum consumer 142 via conduit 144, and a mixed flow outlet via which air that has passed through venturi 140 can exit and be directed to a low-pressure sink, such as intake manifold 44. Air flowing through the motive inlet may be converted to flow energy in the venturi 140, thereby creating a low pressure communicated to the throat (or entraining inlet) and drawing a vacuum at the throat. The vacuum at the throat of the venturi draws air from conduit 144, thus providing vacuum to vacuum consumer 142. An optional check valve may allow vacuum consumer 142 to retain any of its vacuum should the pressures in the venturi's motive inlet and the vacuum consumer equalize. In the present example, the venturi is a three port device including a motive inlet, a mixed flow outlet, and a throat/entraining inlet. However, in alternate embodiments of the venturi, a check valve may be integrated into the venturi. The vacuum consumer may be a suitable component that utilizes vacuum as an actuation force, such as the vehicle brake system, fuel vapor control system, vacuum-actuated valve, etc. The vacuum consumer may alternatively be a vacuum reservoir configured to store and supply vacuum to other vacuum consumers.

As explained in more detail below with respect to FIGS. 2A and 2B, the inlet of the venturi and the throttle plate may interface when the throttle is in a given position, such as partially open. For example, when the throttle is wide open, intake air may flow through the entirety of the intake passage, including the venturi. As such, the pressure difference across the throttle and the venturi may be small. However, as the throttle moves towards a closed position, more of the air may be directed through the venturi, generating vacuum in the venturi. Due to the flow of intake air through the venturi, more vacuum may be produced when the throttle is in relatively open positions than is produced across the throttle itself. In this way, vacuum may be generated in the venturi even when the throttle is not in a position to produce sufficient vacuum.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. The controller 12 may receive various signals and information from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Storage medium read-only memory 106 can be programmed with computer readable data representing instructions executable by processor 102 for performing the methods described below as well as variations thereof.

As described above, FIG. 1 shows only one cylinder of a multi-cylinder engine, and that each cylinder may similarly include its own set of intake/exhaust valves, fuel injector, spark plug, etc. Further, additional engine components not illustrated in FIG. 1 that may be included in the engine include a turbocharger, comprising a turbine positioned in the exhaust and a compressor positioned in the intake, and an exhaust gas recirculation system including a conduit configured to divert a portion of the exhaust back to the intake.

Turning now to FIGS. 2A and 2B, intake passage 42, throttle 62, and venturi 140 are illustrated in greater detail. The direction of the intake airflow, which travels across throttle 62 and venturi 140 before reaching the intake manifold and engine, is depicted by the arrows in FIG. 2A. As shown in FIG. 2A, venturi 140 may include an inlet 146, an outlet 148, and a port 150 coupling venturi 140 to conduit 144 and vacuum consumer 142 (not shown in FIG. 2A). FIG. 2B illustrates the intake passage 42 in cross-section along the line X-X', with the upper wall of the venturi 140 extending across a bottom portion of the intake passage. Venturi 140 may be positioned asymmetrically within intake passage 42 and relative to throttle 62. In other words, venturi 140 may extend across a bottom portion of the intake passage 42 on the downstream side of throttle 62. However, in some embodiments, venturi 140 may be instead positioned on the upstream side of throttle 62.

The inlet 146 of the venturi 140 may interface with an edge of the throttle plate 64 when the throttle is in a partially open position. Prior to reaching the partially open position, such as when the throttle is wide open, intake air may flow substantially through and around venturi 140. As such, the pressure drop across the venturi, as well as across the throttle, may be small, and thus only a small amount of vacuum may be generated. However, once the throttle moves towards the closed position, the edge of the throttle may interface with the inlet of the venturi, as shown in FIG. 2A. Substantially all of the intake air flowing on the inward-facing side of the throttle may be directed through the venturi, increasing the pressure drop and vacuum generation. As the throttle moves more towards the fully closed position, the pressure drop across the throttle itself may be sufficient to generate vacuum.

The venturi may be designed such that the throttle angle at which the edge of the throttle interfaces with the venturi may be larger than a throttle angle that would otherwise produce sufficient vacuum for driving one or more vacuum consumers. For example, without the venturi positioned in the intake, sufficient vacuum may be produced only when the throttle is at an angle of 30° or smaller. However, with the inclusion of the venturi, the throttle may interface with the venturi at a throttle angle of 45°, thus producing vacuum over an increased range of throttle angles.

In some embodiments, a second venturi 152 may be positioned in intake passage 42 upstream of throttle 62. Second venturi 152 may be similar to venturi 140, including an inlet, outlet, and throat. Second venturi 152 may include a port coupling venturi 152 to conduit 154. Conduit 154 may route vacuum generated by second venturi 152 to one or more vacuum consumers (not shown in FIG. 2A). Second venturi 152 may interface with the outward-facing edge of throttle plate 64 when the throttle is in a partially open position. By including a second venturi upstream of the throttle as well as a venturi downstream of the throttle, vacuum may be generated via the entirety of the intake air flow.

FIG. 3 illustrates a method 300 for generated vacuum in an intake of an engine. Method 300 may be carried out by controller 12 according to instructions stored thereon. In one example, method 300 may generate vacuum via a venturi, such as venturi 140, positioned on a downstream side or on an upstream side of a throttle, such as throttle 62. At 302, method 300 includes determining operating parameters. The operating parameters determined at 302 may include, but are not limited to, engine speed, engine load, operator-requested torque, mass air flow, air-fuel ratio, fuel injection quantity, etc.

At 304, the position of the throttle may be adjusted to provide a desired throttle angle. The desired throttle angle may be based on one or more engine operating parameters in order to deliver a target flow of intake air to the engine. The desired throttle angle may be based on a desired mass air flow in one example. The desired mass air flow may be determined based on an operator torque request, current air mass flow, and/or other parameters. At 306, fuel is injected to the engine in an amount to maintain a desired air-fuel ratio. For example, the engine may be operating with stoichiometric air-fuel ratio, and as the amount of air delivered to the engine changes to meet a torque request, the amount of fuel may be adjusted to maintain the stoichiometric air-fuel ratio.

At 308, method 300 includes generating vacuum at the throttle. Vacuum may be generated at the throttle based on a pressure drop across the throttle itself, or based on a pressure drop across a venturi positioned proximate to the throttle. As indicated at 310, intake air flows through a venturi positioned on a downstream side of the throttle. Other than when the throttle is fully closed, at least a portion of the intake air will flow through the venturi. As indicated at 312, vacuum may be generated by flow through the venturi when the throttle is in a range of positions. For example, when the throttle is partially open (e.g., at an angle of 45°), the edge of the throttle may interface with the inlet of the venturi, and nearly all the intake air flowing on the inward-leaning side of the throttle (e.g., the air flowing under the throttle) may be routed through the venturi, thus generating vacuum. However, when the throttle is fully open, some of the intake air will also flow around the venturi, such as over the top of the venturi, reducing the vacuum generation in the venturi. Additionally, when the throttle is in a partially to mostly closed position (e.g., throttle angles less than 30°), the pressure drop across the throttle may be larger than across the venturi, and thus vacuum may be generated by flow across the throttle, as indicated at 314. The vacuum generated by flow through the venturi and/or by flow across the throttle may be applied to one or more vehicle vacuum consumers, such as the vehicle brake system.

At 316, method 300 judges whether the throttle is moving into or out of interfacing with the inlet of the venturi. As depicted in FIG. 2A, the edge of the throttle may interface with or be substantially aligned with the inlet of the venturi when the throttle is in a certain position. If the throttle is at a wider-open position (e.g., larger throttle angle) and then begins to close, as it reaches the interface with the venturi, an air flow disturbance may be created due to the intake air flow being drawn through the venturi. For example, the air flow to the engine may decrease when the throttle reaches the interface. Similarly, if the throttle is at a position past the interface (e.g., smaller angle) and begins to open, air flow may increase after the throttle passes the interface with the venturi. To compensate for these air flow disturbances, if it is determined at 316 that the throttle is moving into or out of the interface with the venturi, fuel injection may be adjusted at 318. The amount of fuel injected may be adjusted, fuel injection timing may be adjusted, and/or other parameters may also be adjusted, such as ignition timing. However, if the throttle is not moving into or out of the interface with the venturi, method 300 proceeds to 320 to maintain the fuel injection parameters determined above.

Thus, method 300 adjusts throttle position to provide a desired air flow to the engine to maintain torque, and based on the throttle position, adjusts fuel injection to maintain a desired air-flow ratio. When the throttle is in a certain position or range of positions, vacuum may be generated by flow through a venturi positioned proximate the throttle. When the throttle reaches or passes the interface with the venturi, an additional adjustment to the fuel injection may be made to account for air flow disturbances.

Method 300 is described above with respect to venturi 140, which is positioned on an inward-leaning, downstream side of the throttle. However, method 300 may additionally or alternatively be performed with respect to a second venturi positioned on outward-leaning, upstream side of the throttle.

In some embodiments, the controller may include instructions to modulate the throttle position around the interface of the venturi to maintain intake air temperature above a target temperature. For example, when ambient temperature is relatively cold, certain engine components, such as sensors, valves, etc., positioned in the intake passage or intake manifold may be prone to degradation. When the intake air flows through the venturi, the temperature of the air may drop due to the increased velocity of the air through the venturi. To maintain a higher intake air temperature when the throttle is at the interface with the venturi, the throttle may oscillate its position around the interface, moving out of the interface occasionally to allow some intake air flow over the venturi. This may prevent a temperature drop and maintain intake air above a target temperature.

Turning now to FIG. 4, a method 400 for maintaining cylinder charge during vacuum generation is provided. Method 400 may be carried out by controller 12 according to instructions stored thereon. At 402, method 400 includes determining engine operating parameters. The engine operating parameters may include but are not limited to throttle position, engine speed, engine load, air-fuel ratio, and fuel injection amount. At 404, method 400 judges whether the throttle is in a position to generate vacuum. This may include the throttle interfacing with or otherwise producing vacuum via a peripheral venturi positioned upstream or downstream of the throttle, or may include the throttle being in a position that produces vacuum via the pressure drop across the throttle itself. If the throttle is in a position to generate vacuum, method 400 proceeds to 406 to maintain the current throttle position, and method 400 returns.

If the throttle is not in a position to generate vacuum, e.g., if the throttle is in an open position beyond the interface with the venturi, method 400 proceeds to 408 to judge if vacuum generation via the throttle is desired. Vacuum may be desired during a fuel vapor purge, for example, or during other operating conditions where vacuum is used to ingest gasses or provide an actuation force. If vacuum generation is not desired, method 400 proceeds back to 406 to maintain current throttle position, and method 400 returns.

If vacuum generation is desired, method 400 proceeds to 410 to move the throttle to a position to generate vacuum, such as at the interface with the venturi. This may include closing the throttle until it interfaces with the venturi, if the throttle is in a substantially open position. At 412, method 400 includes adjusting engine operating parameters in order to maintain desired engine torque. When the throttle position is adjusted at 410, the amount of air reaching the cylinders may change. To maintain the engine torque at the operator-requested level, one or more operating parameters may be adjusted. As indicated at 414, boost pressure generated by a turbocharger of the engine may be adjusted. For example, if the throttle is closed, boost pressure may be increased to deliver more air across the throttle, thus maintaining the same amount of air to the cylinders. Additionally or alternatively, valve timing may be adjusted, as indicated at 416. By adjusting the timing of opening and/or closing the intake and/or exhaust valves, additional air may be inducted into the cylinders. Further, as indicated at 418, the rate of exhaust gas recirculation (EGR) may be adjusted. EGR reduces the amount of oxygen in the cylinder charge, thus, if the throttle is closed at 410, the amount of EGR directed to the engine may be decreased to maintain torque. Other adjustments to maintain torque are possible, such as adjusting ignition timing and/or adjusting fuel injection. Method 400 then returns.

Thus, method 400 provides for commanding a change in throttle position in order to generate vacuum via the venturi positioned proximate the throttle. When the throttle position changes, air flow to the engine also changes. To maintain torque responsive to the adjustment in throttle position, one or more engine operating parameters may be adjusted. These include boost pressure, valve timing, and EGR rate. Further, in some embodiments, fuel injection parameters may also be adjusted, such as fuel injection amount. In this way, torque may be maintained during the commanded vacuum generation.

FIG. 5 is a diagram 500 illustrating example operating parameters that may occur during the execution of the above-described methods. Specifically, diagram 500 illustrates throttle position, the pressure drop across the venturi and across the throttle, boost pressure, and fuel injection quantity. For each depicted operating parameter, time is illustrated along the horizontal axis and the respective operating parameter value is illustrated along the vertical axis.

Referring first to throttle position, it is illustrated in diagram 500 by curve 502. The throttle position may be adjusted to a suitable position between fully open fully closed, based on desired intake air flow, for example. The dashed line 504 represents the position of the throttle where the edge of the throttle interfaces with the inlet of the venturi positioned proximate to the throttle.

Prior to time t1, the throttle is at a relatively open position, beyond the interface with the venturi. As a result, air may flow nearly equally over and through the venturi. As shown by curve 506, the pressure drop across the venturi may be relatively low when the throttle is in the more open position. Similarly, the pressure drop across the throttle, illustrated by curve 508, may also be low.

Just before time t1, the controller may determine a desire for vacuum generated by the venturi. For example, a fuel vapor purge may be performed or a vacuum-actuated valve may be commanded to change position. However, the position of the throttle may not be creating a large enough pressure drop across the throttle and/or venturi to produce sufficient vacuum. Thus, at time t1, the throttle may be closed until it interfaces with the venturi. As a result, the pressure drop across the venturi may increase, thus increasing the generation of vacuum. In order to maintain desired cylinder air flow, one or more operating parameters may be adjusted in response to the adjusted throttle position. Curve 510 illustrates that boost pressure is increased following time t1 in order to deliver additional air to the throttle. Further, as shown in curve 512, fuel injection quantity may be decreased as the throttle interfaces with the venturi. An airflow disturbance may be introduced when the throttle initially interfaces with the venturi, and thus to maintain a stoichiometric air-fuel ratio, fuel injection quantity may be decreased.

At time t2, the throttle may be moved to a more closed position, based on an engine air flow request. Thus, the pressure drop across the venturi may decrease, and boost pressure may return to a desired boost pressure based on engine speed and load, for example. However, the pressure drop across the throttle may increase due to the closing of the throttle. Around time t3, the throttle may begin to move towards a more open position, and interface with the venturi at time t3, before moving away from the venturi. The interface with the venturi may result in a temporary increase in pressure across the venturi, and cause an increase in the fuel injection amount. Further, because the throttle was moved due to an air flow request and not based on desired vacuum, boost pressure may be maintained at the commanded boost pressure.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

a throttle positioned in an intake passage of an engine;

a first peripheral venturi extended across a bottom portion of the intake passage and positioned asymmetrically inside the intake passage on a downstream side of the throttle, the first peripheral venturi having an inlet positioned to interface with a first lower downstream edge of the throttle when the throttle is in a partially open position at a first angle; and a second peripheral venturi extended across an upper portion of the intake passage and positioned asymmetrically inside the intake passage on an upstream side of the throttle, the second peripheral venturi having an outlet positioned to interface with a second higher upstream edge of the throttle when the throttle is in the partially open position at the first angle.

2. The system of claim 1, further comprising a first vacuum port coupling the first peripheral venturi to a vacuum consumer and a second vacuum port coupling the second peripheral venturi to a vacuum consumer.

3. A method for an engine, comprising:

generating vacuum via intake air flow through a first peripheral venturi positioned asymmetrically inside an intake passage downstream of a throttle and extended across a bottom portion of the intake passage, the first peripheral venturi having an inlet positioned at an interface with a downstream edge of the throttle when the throttle is in a partially open position at a first angle, and further comprising generating vacuum via intake air flow through a second peripheral venturi positioned asymmetrically inside the intake passage upstream of the throttle and extended across an upper portion of the intake passage, the second peripheral venturi having an outlet positioned at an interface with an upstream edge of the throttle when the throttle is in the partially open position at the first angle.

4. The method of claim 3, further comprising applying vacuum from the first peripheral venturi to a vacuum consumer and applying vacuum from the second peripheral venturi to a vacuum consumer.

5. The method of claim 3, further comprising, when the inlet of the first peripheral venturi interfaces with the downstream edge of the throttle and the outlet of the second peripheral venturi interfaces with the upstream edge of the throttle, adjusting a fuel injection amount and timing to one or more cylinders of the engine.

6. The method of claim 5, further comprising decreasing a fuel injection quantity to the one or more cylinders of the engine when the inlet of the first peripheral venturi interfaces with the downstream edge of the throttle and the outlet of the second peripheral venturi interfaces with the upstream edge of the throttle.

7. The method of claim 3, further comprising, when the throttle is at the interfaces with the first and second peripheral venturis, oscillating the position of the throttle around the interfaces, including moving the throttle out of the interfaces occasionally to allow some intake air flow over the first and second peripheral venturis.

8. A method for an engine comprising:

adjusting a position of a throttle arranged in an intake passage based on a desired level of vacuum across the throttle;

generating vacuum via intake air flow through a first peripheral venturi positioned asymmetrically inside the intake passage downstream of the throttle and a second peripheral venturi positioned asymmetrically inside the intake passage upstream of the throttle, wherein the first peripheral venturi has an inlet positioned at an interface with an inward-facing downstream edge of the throttle when the throttle is in a partially open position at a first angle, and wherein the second peripheral venturi has an outlet positioned at an interface with an outward-facing upstream edge of the throttle when the throttle is in the partially open position at the first angle; and adjusting an operating parameter to maintain torque responsive to the adjusting of the position of the throttle.

9. The method of claim 8, wherein the operating parameter comprises boost pressure.

10. The method of claim 8, wherein the operating parameter comprises valve timing.

11. The method of claim 8, wherein the operating parameter comprises exhaust gas recirculation rate.

12. The method of claim 8, further comprising adjusting fuel injection to one or more cylinders of the engine responsive to the adjusting of the position of the throttle.

13. The method of claim 12, wherein adjusting fuel injection to one or more cylinders of the engine responsive to the adjusting of the position of the throttle comprises decreasing the fuel injection to one or more cylinders of the engine as the throttle interfaces with the first and second peripheral venturis.

14. The method of claim 8, further comprising applying the vacuum to a vacuum consumer.

15. The method of claim 8, wherein adjusting the position of the throttle further comprises adjusting the throttle to the partially open position at the first angle to interface the downstream edge of the throttle with the inlet of the first peripheral venturi and to interface the upstream edge of the throttle with the outlet of the second peripheral venturi.

16. The method of claim 8, further comprising, when the throttle is at the interfaces with the first and second peripheral venturis, oscillating the position of the throttle around the interfaces, including moving the throttle out of the interfaces occasionally to allow some intake air flow over the first and second peripheral venturis.

* * * * *